United States Patent [19]

Arneberg

[11] Patent Number: 4,514,878

[45] Date of Patent: May 7, 1985

[54] REVERSIBLE ADJUSTABLE TORSION DOOR CLOSER

[75] Inventor: Walter Arneberg, Anoka, Minn.

[73] Assignee: Ideal Security Hardware Corporation, St. Paul, Minn.

[21] Appl. No.: 416,871

[22] Filed: Sep. 13, 1982

[51] Int. Cl.[3] ..... E05F 1/08

[52] U.S. Cl. ..... 16/300; 16/76; 403/146; 403/149

[58] Field of Search ..... 16/58, 65, 70, 72, 75, 16/76, 77, 80, 298, 299, 300, 301, DIG. 36; 403/146, 149; 267/58

[56] References Cited

U.S. PATENT DOCUMENTS

| | | | |
|---|---|---|---|
| 2,066,795 | 1/1937 | Moore | 16/76 X |
| 3,426,387 | 2/1969 | Bitney | 16/300 |
| 3,510,986 | 5/1970 | Berkowitz | 16/76 X |
| 4,050,115 | 9/1977 | Gwodz | 16/298 |

FOREIGN PATENT DOCUMENTS

| | | | |
|---|---|---|---|
| 458995 | 8/1912 | France | 16/300 |
| 2845 | of 1860 | United Kingdom | 16/300 |

*Primary Examiner*—Fred A. Silverberg

*Attorney, Agent, or Firm*—Merchant, Gould, Smith, Edell, Welter & Schmidt

[57] ABSTRACT

A torsion spring door closer assembly for use with a in-swinging, out-swinging, right-handed or left-handed door. The door closer assembly is reversible so that it can be easily adapted to the various door styles above. Further, the closing force provided by the assembly can easily be adjusted. The door closer assembly includes a torsion spring (58) and a housing (56) comprising a top portion (60) and a bottom portion (62). The top portion (60) is disposed for angular movement relative to the bottom portion (62). Attached to one of the top and bottom portions of the housing is a known door closer assembly comprising a cylinder (52) and a rod (54) extending therefrom. The door closer further comprises a mounting bracket (76) which cooperates with the door closer to provide the features of reversibility, and adjustability of the door closing force.

1 Claim, 5 Drawing Figures

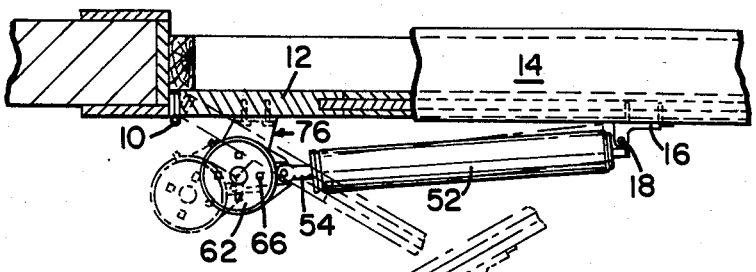
FIG. 1
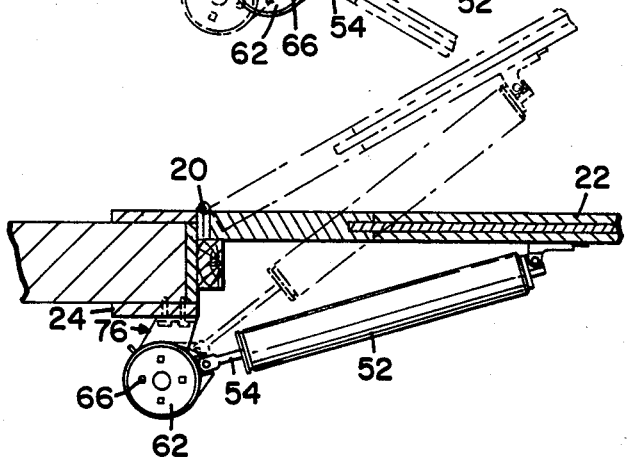
FIG. 2
FIG. 3
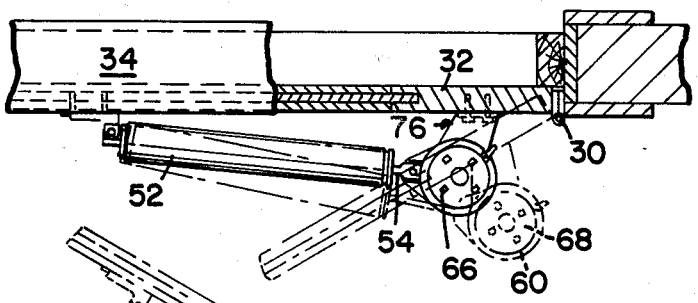
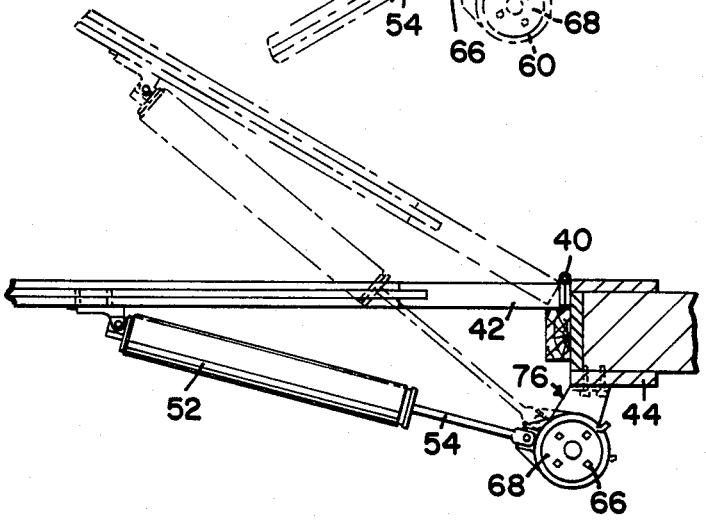
FIG. 4

REVERSIBLE ADJUSTABLE TORSION DOOR CLOSER

TECHNICAL FIELD

The present invention relates generally to door closer assemblies which can be installed on doors to automatically return them to a closed position once they are opened. More particularly, this invention relates to a reversible and tension variable door closer comprising a torsion spring, and a bracket for mounting, in combination with a known door closer assembly, wherein the door closer can be used on an in-swinging, out-swinging, left-handed, or right-handed door, and the force with which the door closer closes a door can be easily adjusted.

BACKGROUND OF THE INVENTION

Many door closer assemblies are known which will cause a door to close once it has been opened. A number of these devices operate with a torsion spring. Generally the spring cooperates with other parts of the door closer to provide a closing force to a door. The devices are generally installed between the door and the frame in such a way that when the door opens, the tension in the spring increases. When the door is no longer being forced open, the tension in the spring releases itself, forcing the door closed.

Known door closers generally have at least two major drawbacks. First, the amount of tension which will be stored in the spring when the door is open cannot always be varied. This stored tension directly relates to the force with which the door closer will close a door. If the stored tension is not variable, the door closer will always close the door with a particular force, even if greater or lesser force is desired. In those door closers which do provide for adjustable spring tension a special wrench is generally required. If the tension needs adjusting, a person must make the effort to locate or obtain such a wrench. This can be difficult and inconvenient, as when the wrench has been misplaced or when the person who desires to make the adjustment was not the individual who purchased the door closer originally and perhaps never owned such a wrench.

Second, known door closers generally are adapted to a particular type of door. Doors can be either right or left-handed and can swing either outwardly or inwardly. A right-handed door has the hinge on the left and opens on the right; a left-handed door has the hinge on the right and opens on the left. An in-swinging door swings toward the person who is opening it. An out-swinging door swings away from the person opening it. Thus, one can have a right-handed in-swinging door, a right-handed outswinging door, a left-handed in-swinging door, or a left-handed out-swinging door.

Many door closers are suitable only for one or two of these door styles. Others can be adapted for use with more styles, but must be disassembled and reassembled in order to adapt. Obviously, this can be inconvenient, and time consuming. Further, adapting the door closer to a particular style of door can require special tools and can be messy due to parts which are oiled or greased and must be handled during the disassembly and reassembly.

The present invention provides a torsion door closer wherein the stored tension or door closing force can be easily adjusted. No special tools are needed.

The present invention can also be easily adapted to left-handed, right-handed, in-swinging, or out-swinging doors, with no special or additional parts or tools needed for adaptation to these various types of doors. Further, the adjustment can be accomplished by simply removing the body of the door closer from a mounting bracket, flipping the door closer around, and reattaching the mounting bracket. It is generally not necessary to disassemble the door closer other than removing it from the bracket. In the preferred embodiment the torsion spring remains within a housing at all times and oily or greasy parts do not have to be handled.

SUMMARY OF THE INVENTION

The present invention is a door closer assembly for use with a door. The assembly comprises a cylinder, and a rod extending axially within the cylinder with one end extending outside it. In combination with this assembly is a torsion spring door closer. The door closer comprises a torsion spring with one end substantially fixed against movement relative to the end of the rod extending from the cylinder. The door closer further comprises a means for causing the torsion spring to gradually assume a more tightly wound position as the door opens, and to gradually assume a less tightly wound position as the door closes. This causes a closing force on the door when the assembly is installed. Further, the door closer comprises a means for adapting it for use with any of a right-handed, left-handed, in-swinging, and out-swinging door, and for providing a choice at the time of installation for the strength of closing force which will be applied to the door.

BRIEF DESCRIPTION OF THE DRAWING

FIG. 1 is a top view showing a preferred embodiment and installation of the door closer assembly on a right-handed, in-swinging door.

FIG. 2 is a top view showing a preferred embodiment and installation of the door closer assembly on a right-handed, out-swinging door.

FIG. 3 is a top view showing a preferred embodiment and installation of the door closer assembly on a left-handed, in-swinging door.

FIG. 4 is a top view showing a preferred embodiment and installation of the door closer assembly on a left-handed, out-swinging door.

DETAILED DESCRIPTION OF THE INVENTION

Figure 5:
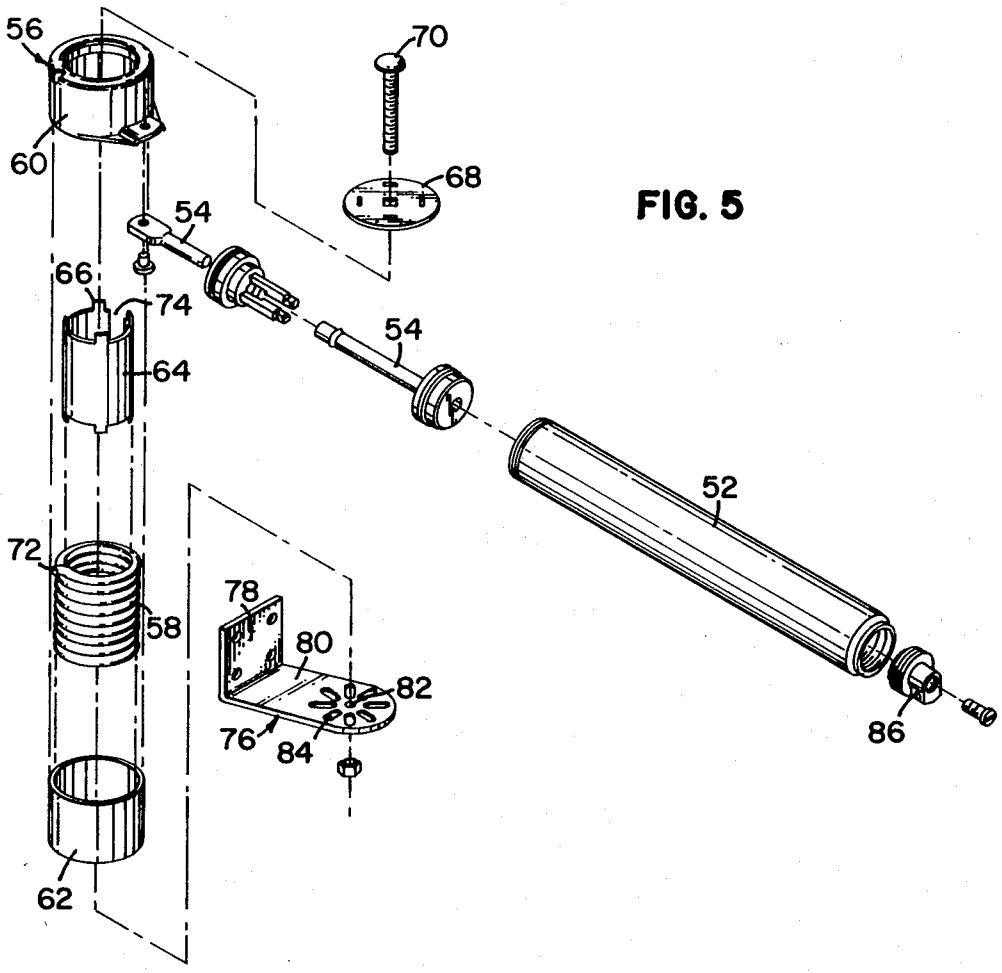
FIG. 5 is an exploded view of the door closer assembly.

Referring now to the drawings wherein like reference numerals denote like elements throughout the several views, FIG. 5 illustrates an exploded view of the door closer assembly 50. This assembly can comprise a cylinder or elongated tubular member 52. Extending axially within the cylinder or tubular member, with one end extending therefrom, can be a rod 54.

The door closer assembly can further comprise a torsion spring door closer 56. The torsion spring door closer can be attached to the end of the rod which extends from the cylinder.

One element of the torsion spring door closer is the torsion spring 58. The coils of the torsion spring will generally encircle an axis which can be substantially perpendicular to the rod 54. One end of the torsion spring can be substantially fixed against movement relative to that end of the rod which extends from the cylinder.

In addition to the torsion spring, the door closer can comprise means for causing the torsion spring, when the door closer assembly is installed for use with a door, to gradually assume a more tightly wound position as the door opens, and to gradually assume a less tightly wound position as the door closes. This causes a closing force on the door.

The means for causing the spring to assume a more or less tightly wound position can comprise a housing which in a preferred embodiment can comprise a top portion 60 and a bottom portion 62 and an engaged end and a nonengaged end. The bottom portion can be disposed for angular movement relative to the top portion about an axis extending through both. (i.e. an axis which extends through the top and bottom portions of the housing). The housing can be attached at one portion to the end of the rod. The rod will then be substantially fixed against movement relative to that portion of the housing, but disposed for angular movement relative to the portion of the housing to which it is not attached.

The torsion spring 58 can be located inside the housing with its coils encircling the axis of the housing (i.e. the axis which extends through the top and bottom portions of the housing). One end of the spring can be sufficiently fixed against movement relative to one portion of the housing, and the other end of the spring can be sufficiently fixed against movement relative to the other portion, that the tension in the spring can be varied by the angular movement of one portion relative to the other.

Within the housing can also be a sleeve 64, having the same axis as the spring and the housing (i.e. the axis which extends through the top and bottom portions of the housing). Like the rod, the sleeve can be fixed against movement relative to one portion of the housing, but disposed for angular movement relative to the other portion. To aid in this relationship to the portions of the housing, the sleeve can include at least one lug 66 at each end of the sleeve. The lugs can extend outside the ends of the housing. At least one lug at one end of the sleeve can engage the housing, while the lug or lugs at the other end do not engage the housing. Stated another way, the housing can have an engaged end and a nonengaged end, so named according to whether one of the lugs engage the housing at that end. At least one of the lugs is located at and engages the engaged end of the housing while at least one of the lugs is located at the nonengaged end of the housing. In this way, the sleeve will be fixed against movement relative to the portion engaged by the lug or lugs (i.e. the engaged end), but disposed for angular movement relative to the other portion where the lugs do not engage the housing (i.e. the nonengaged end).

The portion of the housing which is not engaged by the lugs (i.e. the nonengaged end) can be open, with the lugs passing through. Sealing the top of this portion and engaging the lugs can be a plate 68. When held together by bolt 70, the plate 68, the sleeve 64, and the bottom portion 62 of the housing will be substantially fixed against angular movement relative to each other. As a unit, they will be disposed for angular movement relative to the top portion 60 of the housing, the rod 54 and cylinder 52. The top portion, the rod, and the cylinder also form a unit in that they are substantially fixed against angular movement relative to each other but move together angularly with respect to the plate, sleeve, and bottom portion.

Returning now to the torsion spring, as noted above, one end of the spring can be sufficiently fixed against movement relative to one portion of the housing, and the other end of the spring can be sufficiently fixed against movement relative to the other portion, that the tension of the spring can varied by the angular movement of one portion relative to the other. In the preferred embodiment, this is accomplished by having one end 72 of the spring protrude from the top portion of the housing 60, in a way substantially locking that end against movement relative to that portion. The other end of the spring, which cannot be seen in the Figures, remains within the housing but extends outside the sleeve 64 through a slot 74. In FIG. 5, the slot extends vertically through the sleeve, from the top where it is visible to the bottom, where it cannot be seen in the Figures. The positioning of the end of the spring in this slot allows that end to be substantially fixed against movement relative to the sleeve, the plate, and also the bottom portion of the housing. With this positioning of the spring, if one portion of the housing moves angularly relative to the other portion, the spring will either coil more tightly or uncoil, to an extent directly related to the extent of angular movement of the portions of the housing.

The door closer can further comprise means for adapting it for use with any of a right-handed, left-handed, in-swinging, and out-swinging door, and for providing a choice at the time of installation for strength of closing force.

The means for adapting the door closer for use with any of the right-handed, left-handed, in-swinging, and out-swinging door, and for providing a choice at the time of installation for strength of closing force, can comprise a mounting bracket 76. The mounting bracket can be substantially fixed against movement when the door closer assembly is installed. Further, in the preferred embodiment, the mounting bracket 76 can be attached to the door closer such that the bracket is substantially fixed against movement relative to the plate 68, the sleeve 64, and the bottom portion 62 of the housing.

The mounting bracket can be attached at either the top or bottom ends of the door closer. Whether the mounting bracket is attached at the top or bottom in part determines whether the door closer is ready for use with a right-handed, left-handed, in-swinging or out-swinging door. Since the mounting bracket can be easily attached at either end of the closer, and can be unbolted and reattached to the other end with a minimum of effort, the door closer assembly can easily be adapted for use with these various door styles.

In the preferred embodiment, the mounting bracket can comprise a member 78 for attachment to a surface such as a door or door frame, and a flat perpendicular member 80 for attachment to the door closer, for example, at the housing, or the plate. In the preferred embodiment, the flat member 80 can comprise a hole 82 through which bolt 70 can pass, and a series of elongated holes 84 into which lugs 66 can fit. The plurality of elongated holes can be spaced radially from the hole 82. The strength of closing force on the door will depend in part upon which of the holes 84 the lugs are placed into.

The door closer assembly can also comprise a bracket 16, known in the art, for mounting the end of the cylinder farthest from the torsion spring. Typically, this bracket is attached to the cylinder by a pivot pin 18 which passes through holes in the bracket and through holes 86 in the end of the cylinder. When the door closer assembly is installed, the bracket for mounting the cylinder is generally mounted on a surface such as the door or door frame.

FIG. 1 illustrates the installed door closer assembly, for use with a right-handed (hinge 10 on left), in-swinging door 12. In FIG. 1, the mounting bracket 76 is mounted on the door near the hinged side, with member 78 (not visible in FIG. 1) pointing downward. The rest of the door closer assembly is positioned on top of the mounting bracket, with what has been called the top portion of the housing, closest to the mounting bracket. The end of the cylinder 52 farthest from the torsion spring is mounted on the door frame 14 above the door, using a bracket 16 and pivot pin 18. The installed door closer assembly as it appears with the door in an open position is illustrated in FIG. 1 in phantom.

FIG. 2 illustrates the door closer assembly in use with a right-handed (hinge 20 on left) out-swinging door 22. Here, the mounting bracket 76 is attached to the door jamb or frame next to the hinged side of the door. The member 78, not visible in this Figure, would be pointed downward. The door closer assembly is positioned on the mounting bracket with the portion 60 of the housing, what has been referred to for convenience sake as the top portion, resting on the mounting bracket. The end of the cylinder 52 away from the torsion spring can be attached to the door, by a bracket 16 and pivot pin 18. The door in the open position and the corresponding position for the door closer assembly is shown in phantom.

FIG. 3 illustrates the use of the door closer assembly with a left-handed (hinge 30 on the right side) in-swinging door 32. The mounting bracket can be positioned at the top of the door itself, near the hinged edge. The bracket can be positioned with the member 78 pointing downward. Resting on flat member 80, with the lugs engaging a portion of the elongated holes, the door closer assembly is attached to the mounting bracket. The bottom portion 62 of the housing is the portion in contact with the mounting bracket. The end of the cylinder farthest from the torsion spring can be mounted by way of a bracket and pivot pin to the door frame or jamb 34 above the door.

FIG. 4 illustrates use of the door closer assembly with a left-handed (hinge 40 on the right side) out-swinging door 42. In this embodiment, the mounting bracket is again positioned with member 78 pointing downward. However, member 78 is preferably attached to the door frame or jamb 44 which is adjacent to the side of the door having the hinge. The bottom portion 62 of the housing is mounted on the mounting bracket, with lugs fitting into certain of the elongated holes. The other end of the assembly can be mounted by way of a bracket and pivot pin to the door itself, preferably near the top. The door in the open position is shown in FIG. 4 in phantom.

As can be seen above, the door closer assembly can be used with a variety of doors, merely by installing it in a particular way. To adapt it for use with a particular door, it is generally unnecessary to disassemble the door closer assembly, beyond the removal of one bolt. This can be done from outside the apparatus and no special tools are required.

The door closer assembly can also be easily adjusted to provide the correct tension or door closing force. It is generally preferred to adjust to the correct tension at the time of installation. To install the assembly and adjust the tension in a preferred way, first, the mounting bracket can be attached to the door or frame, depending on the type of door. With the door open as far as possible and the door closer assembly held approximately parallel and next to the door, the assembly can be placed on the mounting bracket with lugs fitting into elongated holes of the bracket. The bolt can be placed through the closer and the mounting bracket, and a nut threaded on, but not tightly. Next, with the door in the closed position, the bracket for the end of the cylinder away from the torsion spring can be mounted on either the door or the frame, at the correct distance to allow the door to close. The cylinder can then be attached to the bracket by a pivot pin and the nut and bolt through the door closer can be tightened. Generally, however, this will not provide exactly the desired amount of tension.

If adjustment is desired, the door can be placed in the closed position, the pivot pin removed from the cylinder and bracket, and the closer assembly can be swung away from the door. Next, the nut can be removed from the bolt on the mounting bracket, and the door closer can be lifted off the mounting bracket. When this has been accomplished, the lugs can be dropped into a different set of the radially elongated holes; that is, the door closer can be moved around its axis either forward or back a short distance. At this point the bolt can be replaced, the nut tightened, and the cylinder again connected to the bracket by a pivot pin. Finally, the amount of tension can be tested. If the desired amount of tension has not been achieved, this adjusting process can be repeated.

Numerous characteristics and advantages of this invention have been set forth in the foregoing detailed description. It will be understood, of course, that this disclosure is in many respects only illustrative. Changes may be made in details, particularly in matters of shape, size and arrangement of parts without exceeding the scope of the invention. Since persons skilled in the art can make various embodiments without departing from the spirit and scope of the invention, the invention is embodied in the claims hereinafter appended.

I claim:

1. In combination with a door closer assembly for use with a door, wherein said assembly comprises a cylinder, and a rod extending axially within the cylinder with one end extending therefrom, a torsion spring door closer comprising:

(a) a housing having an engaged end and a nonengaged end, and a top portion, and a bottom portion which is disposed for relative angular movement with respect to the top portion about an axis which extends through the top and bottom portions of the housing, said housing being attached at one of the top and bottom portions to the end of the rod which extends from the cylinder, said rod being disposed for relative angular movement with respect to the portion of the housing to which it is not attached;

(b) a torsion spring having coils which encircle the axis which extends through the top and bottom portions of the housing, wherein one end of the spring is sufficiently fixed against movement relative to one portion of the housing and the other end of the spring is sufficiently fixed against movement relative to the other portion, that the tension of the spring can be varied by the angular movement of one portion relative to the other portion;

(c) a sleeve located inside the housing and around the axis which extends through the top and bottom portions of the housing;

(d) at least two lugs, at least one at each end of the sleeve and extending outside the housing, wherein at least one of the lugs is located at and engages the engaged end of the housing while at least one of the lugs is located at and does not engage the nonengaged end of the housing;

(e) a plate located at the nonengaged end of the housing, said plate engaging said at least one of the lugs located at the nonengaged end of the housing, thus fixing the plate against movement relative to the sleeve;

(f) a reversible tension adjusting mounting bracket disposed for engagement with the sleeve, wherein the bracket can engage the sleeve in a variety of positions which correspond to particular strengths of closing force for the door closer assembly when installed, said bracket being fixed against movement when the door closer assembly is installed.

* * * * *